US007343975B2

(12) United States Patent
Surjaatmadja et al.

(10) Patent No.: US 7,343,975 B2
(45) Date of Patent: Mar. 18, 2008

(54) METHOD FOR STIMULATING A WELL

(75) Inventors: Jim B. Surjaatmadja, Duncan, OK (US); Billy W. McDaniel, Duncan, OK (US); Mark Farabee, Houston, TX (US); Loyd East, Carrolton, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 252 days.

(21) Appl. No.: 11/221,022

(22) Filed: Sep. 6, 2005

(65) Prior Publication Data

US 2007/0051517 A1 Mar. 8, 2007

(51) Int. Cl.
*E21B 43/11* (2006.01)

(52) U.S. Cl. ..... 166/297; 166/308.1

(58) Field of Classification Search ..... 166/297, 166/298, 308.1, 55

See application file for complete search history.

(56) References Cited

U.S. PATENT DOCUMENTS

| | | | | |
|---|---|---|---|---|
| 2,769,497 | A | 11/1956 | Reistle, Jr. | |
| 2,776,014 | A | 1/1957 | Lee et al. | |
| 2,969,841 | A | 1/1961 | Thomas | |
| 2,986,214 | A | 5/1961 | Wiseman, Jr. et al. | |
| 3,430,701 | A * | 3/1969 | Canada | 166/269 |
| 4,047,569 | A | 9/1977 | Tagirove et al. | |
| 5,472,049 | A * | 12/1995 | Chaffee et al. | 166/250.1 |
| 5,765,642 | A | 6/1998 | Surjaatmadja | |
| 6,273,195 | B1 * | 8/2001 | Hauck et al. | 166/374 |
| 6,286,600 | B1 | 9/2001 | Hall et al. | |
| 6,394,184 | B2 | 5/2002 | Tolman et al. | |
| 6,520,255 | B2 | 2/2003 | Tolman et al. | |
| 6,543,538 | B2 | 4/2003 | Tolman et al. | |
| 2004/0206504 | A1 | 10/2004 | Rosato | |
| 2005/0061520 | A1 | 3/2005 | Surjaatmadja et al. | |
| 2005/0178551 | A1 * | 8/2005 | Tolman et al. | 166/297 |

OTHER PUBLICATIONS

Foreign communication related to a counterpart application dated Nov. 13, 2006.
U.S. Appl. No. 11/072,725, filed Mar. 4, 2005, Alba et al.

* cited by examiner

*Primary Examiner*—William P Neuder
(74) *Attorney, Agent, or Firm*—John W. Wustenberg; Baker Botts, L.L.P.

(57) ABSTRACT

A bottomhole assembly (BHA) and method for stimulating a well includes setting a packer of the BHA in a wellbore. The BHA includes the packer and a jetting tool coupled to a tubing string. Process fluid is pumped down the tubing string and jetted with the jetting tool to perforate a formation. Stimulation process fluid is pumped down an annulus of the wellbore to fracture the formation.

10 Claims, 3 Drawing Sheets

METHOD FOR STIMULATING A WELL

BACKGROUND

The present invention relates generally to methods and apparatus for preparing and treating a well, and more particularly to a bottomhole assembly and method for stimulating a well.

Various procedures have been utilized to increase the flow of hydrocarbons from subterranean formations penetrated by wellbores. For example, a commonly used production enhancement technique involves creating and extending fractures in the subterranean formation to provide flow channels therein through which hydrocarbons flow from the formation to the wellbore. The fractures are created by introducing a fracturing fluid into the formation at a flow rate which exerts a sufficient pressure on the formation to create and extend fractures therein. Solid fracture proppant materials, such as sand, are commonly suspended in the fracturing fluid so that upon introducing the fracturing fluid into the formation and creating and extending fractures therein, the proppant material is carried into the fractures and deposited therein, whereby the fractures are prevented from closing due to subterranean forces when the introduction of the fracturing fluid has ceased.

Hydraulic fracturing may be performed with jetting tools that use high pressure nozzles to perforate the formation. Perforating is followed by fracture fluids which fracture the formation. Alternatively, hydraulic fracturing may be performed using high volume, low pressure flow. For this type of fracturing, fracture fluids may be pumped down the tubing string and/or annulus of the wellbore.

SUMMARY

A bottomhole assembly (BHA) and method for stimulating a well are provided for use in oil, gas, geothermal, and other wells. A bottomhole assembly may in one embodiment include a jetting tool and a packer to provide hydraulic fracturing using a combination of jetting and annular fluid flow.

In accordance with a particular embodiment, a method for stimulating a well includes setting a packer of a BHA in a wellbore. The BHA includes the packer and a jetting tool coupled to a tubing string. Frac or other jetting process fluid is jetted with the jetting tool to perforate a formation. Stimulation process fluid is pumped down an annulus of the well to fracture the formation.

According to particular embodiments, jetting may be continued while pumping the process fluid down the annulus of the wellbore for fracturing of the formation. In another embodiment, jetting may be discontinued while pumping the process fluid down the annulus of the wellbore. In yet another embodiment, jetting may be performed at a different pressure while pumping the process fluid down the annulus of the wellbore for formation fracture. In yet another embodiment, the stimulation process fluid may be pumped through the jets after the perforating stage to fracture the formation; while another process fluid is pumped through the annulus when needed.

Technical advantages of one or more embodiments of the BHA include providing a tool that allows stimulation to be done in alternative manners. For example, the BHA may be used to stimulate a wellbore using jetting to perforate, immediately followed by fracture fluids to fracture. The BHA may also continue to jet at full, reduced, or even higher pressure while fracture fluids are pumped down the annulus.

Various embodiments of the BHA and method may include all, some, or none of the advantages described above. Moreover, other technical advantages will be readily apparent from the following figures, descriptions, and claims.

BRIEF DESCRIPTION OF THE DRAWINGS

A more complete understanding of the present disclosure and advantages thereof may be acquired by referring to the following description taken in conjunction with the accompanying drawings.

DETAILED DESCRIPTION

Figures 1A, 1B, 2:
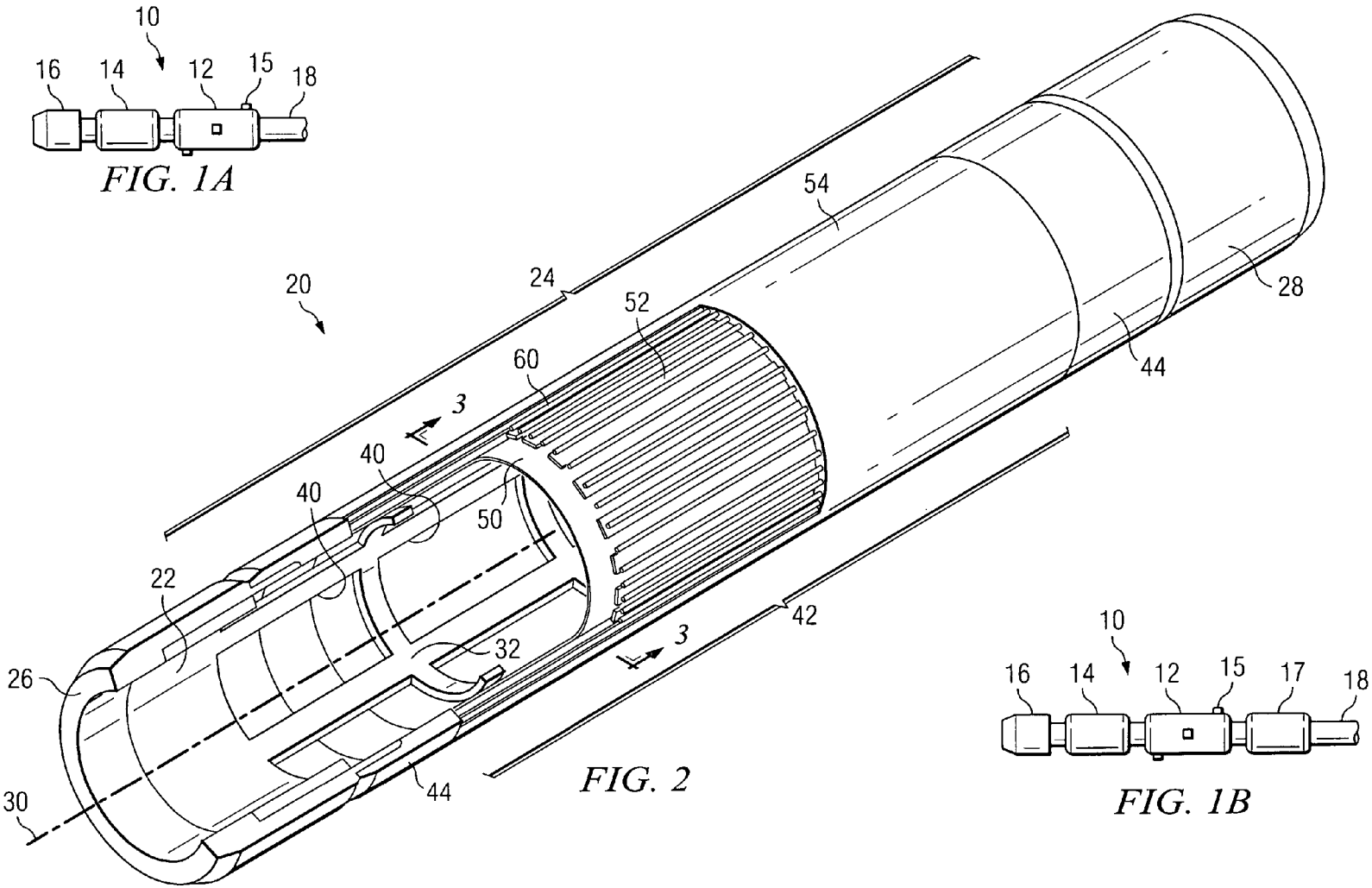
FIG. 1A illustrates one embodiment of a bottomhole assembly (BHA) for stimulating a well.
FIG. 1B illustrates one embodiment of a bottomhole assembly (BHA) for stimulating a well in which inflatable packers exist above and below a jetting tool.
FIG. 2 illustrates one embodiment of the fluid inflatable packer of the BHA of FIG. 1.

FIG. 1A illustrates one embodiment of a bottomhole assembly (BHA) 10 and FIG. 1B illustrates another embodiment of BHA 10. In both embodiments, BHA 10 includes a jetting tool 12, a packer 14 disposed below jetting tool 12, and a valve 16 connected to a tubing string 18. In the embodiment of FIG. 1B, BHA 10 also includes a packer 17 disposed above jetting tool 12.

The jetting tool 12 may have one or more jets 15 operable to provide hydraulic jetting process fluid, stimulation process fluid, or other suitable process fluid at high pressure to perforate a surrounding formation. In a particular embodiment, the jets 15 are sized such that sufficient pressure drop is generated between the inside of tubing string 18 in the annulus of the wellbore being drilled.

The packers 14 and 17 may be fluid inflatable, mechanical, or other suitable packers operable to seal or substantially seal the annulus of the wellbore being drilled. In a particular embodiment, the packer 14 is a fluid inflatable packer that inflates and deflates with process fluid pressure. Valve 16 may be a ball valve, a check valve, a flow actuated check valve or other suitable valve. In the ball valve embodiment, valve 16 may be initially opened to allow process fluid to circulate prior to stimulation and the ball dropped into the tubing string to seal valve 16 and commence jetting. In this embodiment, the ball valve may thereafter allow fluid to flow from the wellbore into the BHA 10, but prevent fluid from flowing from the BHA 10 out into the wellbore except through the jetting tool 12. Valve 16 may be a bleed or other suitable valve.

FIG. 2 illustrates details of a fluid inflatable packer 20 for the BHA 10. In this embodiment, the fluid inflatable packer 20 may be inflated with unfiltered process fluid and may inflate and deflate with process fluid pressure. In other embodiments, the fluid inflatable packer 20 may inflate with filtered or otherwise treated process fluid and/or may not inflate and deflate with process fluid pressure.

Referring to FIG. 2, the fluid inflatable packer 20 includes an open mandrel 22, a packer element 24 disposed outwardly around or otherwise about the open mandrel 22, an upper sub 26, and a lower sub 28. A main longitudinal passageway 30 extends through the open mandrel 22 and forms the interior of the open mandrel 22. The open mandrel 22 may be omitted from the fluid inflatable packer 20 without departing from the scope of the present invention.

The open mandrel 22 provides a frame for the fluid inflatable packer 20 and may be formed of one or more pieces. For example, the open mandrel 22 may be machined from a single piece of material or formed from longitudinal or crisscrossing bars, cables and/or rods. The open mandrel 22 has an elongated tubular body 32 with at least one opening 40 along its length. The elongated tubular body 32 is substantially longer than it is wide and may have a cross-section that is circular or otherwise suitably shaped. In the illustrated embodiment, the elongated tubular body 32 includes a plurality of openings 40 along its length. The openings 40 may be substantially evenly spaced around the circumference of the elongated tubular body 32 and along its length. The openings 40 may be square or rectangular in shape as shown or may be other suitable shapes, such as quadrilateral shaped, round shaped, oval shaped, etc. The openings 40 may form, take up, or otherwise comprise a majority of the surface area of the open mandrel 22. In a particular embodiment, the openings 40 may comprise from twenty to eighty, or more percent of the surface area of the open mandrel 22 that is covered by an inflatable portion of the packer element 24. Thus, a substantial or a majority portion of the interior of the packer element 24 is directly exposed to pressurized process fluid in the main longitudinal passageway 30 of the open mandrel 22.

The packer element 24 includes an inflatable element 42 disposed between and coupled to tensioning collars 44. The tensioning collars 44 maintain the inflatable element 42 in tension such that the inflatable element 42 is biased to deflate, or contract, with a reduction in pressure in the main longitudinal passageway 30 of the open mandrel 22. The tensioning collars 44 may be any collar or other suitable device fixedly or otherwise secured or coupled to the open mandrel 22 such that the inflatable element 42 can be maintained in tension. The tensioning collars 44 may be fixedly secured to the open mandrel 22 by being directly affixed to the open mandrel 22 or to another item or items directly or indirectly coupled to the open mandrel 22. Thus, in some embodiments, the tensioning collars 44 may be indirectly coupled to or about the open mandrel 22 and may move laterally or otherwise about the open mandrel 22. In a particular embodiment, one or both of the tensioning collars 44 may be acted on by a spring (not shown) laterally biasing the one or both tensioning collars 44 away from each other.

The inflatable element 42 may overlay all or only a portion of the open mandrel 22. In the illustrated embodiment, the inflatable element 42 overlays a majority of the open mandrel 22 and a majority of the openings 40 in the open mandrel 22. The inflatable element 42 may include a bladder 50 directly overlaying the open mandrel 22, a reinforcing element 52 disposed outwardly of the bladder 50, and a cover 54 disposed outwardly of the reinforcing element 52. The bladder 50 forms an inner tube which is a pressure-holding member and may be fabricated of an elastomer or other suitable material. The bladder 50 is directly exposed to the openings 40 in the open mandrel 22, and thus to the main longitudinal passageway 30 through the open mandrel 22. The bladder 50 forms a seal between the interior and exterior of the fluid inflatable packer 20.

The reinforcing element 52 may comprise a weave or slat element reinforcing the bladder 50. In the illustrated embodiment, the reinforcing element 52 comprises a plurality of elongated, sheet-like steel slats 60, which may be rods, wire, bars and the like. The sheet-like steel slats 60 extend lengthwise along the bladder 50 and are arranged in an overlapping series of layers progressing circumferentially around the bladder 50 to form a full annular layer between the bladder 50 and the cover 54. The sheet-like steel slats 60 are secured by the tensioning collars 44 and held in tension by the tensioning collars 44. In another embodiment, the reinforcing element 52 may comprise a plurality of elongated, sheet-like steel slats in a weave element construction. In this embodiment, the weave may have a high incidence angle to facilitate deflation of the fluid inflatable packer 20 with the reduction of process fluid pressure in the main longitudinal passageway 30 of the open mandrel 22. The reinforcing element 52 may be otherwise suitably formed or omitted. In a particular embodiment, the reinforcing element 52 may include additional reinforcements at each edge of the reinforcing element 52 or proximate the tensioning collars 44 to prevent or limit severe folds or limit expansion of the inflatable element 42 and/or prevent or limit permanent sets of the fluid inflatable packer 20 in a wellbore. When using solid steel slats, a spring element may be used to improve elongation capability, while weave elements may typically be elastic enough to accept the deformation/elongation.

The cover 54 may be an elongated continuous sleeve-like member formed of an elastomer or other suitable material. For example, the cover 54 may be oil resistant rubber such as nitrile. In operation, the cover 54 seals against the wellbore to prevent, limit, or otherwise control the flow of fluids in the annulus of the wellbore.

In a particular embodiment of the fluid inflatable packer 20, the packer element 24 may have a length of approximately 10 feet and be configured to provide a one inch spacing between the fluid inflatable packer 20 and the inside of the wellbore or casing string in the deflated or relaxed state. In this embodiment, the inflatable element 42 may be held at a tension of about two hundred fifty pounds by tensioning collars 44. Approximately sixty-five percent of the inside of the inflatable element 42 may be directly exposed to fluid and pressure in the main longitudinal passageway 30 of the open mandrel 22 through the underlying openings 40.

The upper sub 26 may be threaded for coupling the fluid inflatable packer 20 to a tubing string. The lower sub 28 may be threaded for coupling the valve 16 or other downhole equipment to the lower end of the fluid inflatable packer 20. As previously described, the valve 16 may be a ball valve, a flow actuated check valve, a bleedoff device, or other suitable terminus that limits flow out of the BHA 10 into the wellbore. For example, the bleed-off device terminates the flow of process fluid except for a small volume at a reduced pressure that is bleed-off to facilitate deflation of the fluid inflatable packer 20. The bleed-off device may be a bleed-off valve, orifice or other suitable device.

Figure 3A:
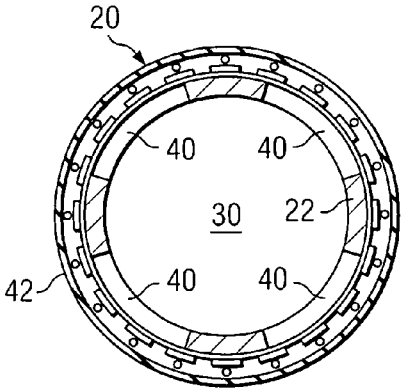
FIGS. 3A-3B illustrate one embodiment of deflated and inflated states of the fluid inflatable packer of FIG. 2 along lines 3-3.
Figure 3B:
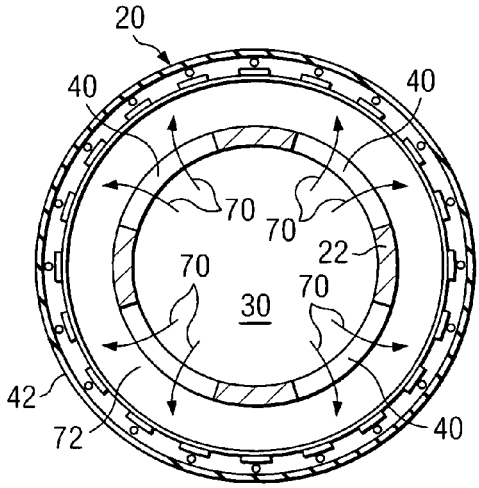

FIGS. 3A-3B illustrate cross-sections of the fluid inflatable packer 20 in the deflated and inflated states in one embodiment. In particular, FIG. 3A illustrates the fluid inflatable packer 20 in the deflated, or relaxed, state. FIG. 3B illustrates the fluid inflatable packer 20 in the inflated, or expanded, state.

Referring to FIG. 3A, in the deflated state, the inflatable element 42 is held in tension against the open mandrel 22 with a substantial portion or majority of the inside of the inflatable element 42 directly exposed to the main longitudinal passageway 30 of the open mandrel 22 through openings 40. As described below, the openings 40 allow process fluid to directly press against and inflate the inflatable element 42 to seal the fluid inflatable packer 20 against a wellbore.

Referring to FIG. 3B, in the inflated state, the inflatable element 42 is inflated to seal against a wellbore by the presence of process fluid 70 in an inflation chamber 72 formed between the inflatable element 42 and the open mandrel 22 by expansion of the inflatable element 42.

In operation, the inflated or deflated state of the fluid inflatable packer 20 will depend on the relative pressure between the main longitudinal passageway 30, which is formed by the interior of the open mandrel 22, and the exterior of the fluid inflatable packer 20, which is the pressure in the annulus of the wellbore in which the fluid inflatable packer 20 is deployed. As pressure of the process fluid 70 increases in the fluid inflatable packer 20, a greater volume of process fluid 70 enters the inflation chamber 72 to expand the inflatable element 42. As pressure decreases, the tension in which the inflatable element 42 is maintained forces process fluid 70 out of the inflation chamber 72 into the main longitudinal passageway 30 of the open mandrel 22 thus deflating, or contracting, the fluid inflatable packer 20 and allowing it to be removed and/or repositioned in the wellbore.

Figure 4:
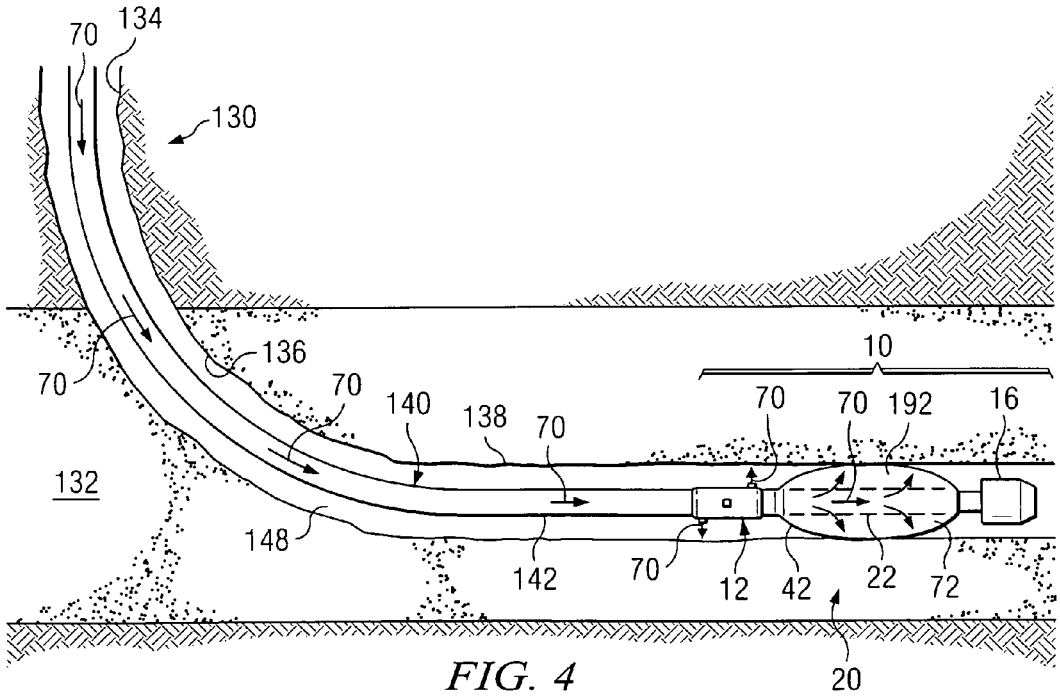
FIG. 4 illustrates one embodiment of a work string including the BHA of FIG. 1 for treating a zone of a wellbore.

FIG. 4 illustrates use of the BHA 10 in a wellbore in connection with a downhole stimulation process. The process may be a well completion process, a production enhancement process, or other suitable process for treating a wellbore. In the illustrated embodiments, the BHA 10 is used in connection with frac processes.

Referring to FIG. 4, a wellbore 130 extends from the surface to a subterranean formation 132. The wellbore 130 may be a vertical, straight, slopping, deviated, or other suitable wellbore 130. In the illustrated embodiment, the wellbore 130 is a deviated wellbore 130 including a substantially vertical portion 134, an articulated portion 136, and a substantially horizontal portion 138. The subterranean formation 132 may be a hydrocarbon producing or other suitable formation.

A work string 140 is disposed in the wellbore 130 and extends from the surface to the subterranean formation 132. The work string 140 includes a tubing string 142 and the BHA 10. The tubing string 142 may be a casing string, section pipe, coil tubing, or suitable tubing operable to position and provide process fluid 70 to the BHA 10.

The BHA 10 includes jetting tool 12, fluid inflatable packer 20 and valve 16. In the illustrated embodiment, the jetting tool 12 is coupled to an upper end of the fluid inflatable packer 20. The ports or jets of the jetting tool 12 are sized such that a sufficient pressure drop is generated between the inside of the tubing string 142 and the annulus 148. The jetting tool 12 may be a hydra jetting tool of the type used in SURGIFRAC fracturing services, or often known as Hydrajet Fracturing services. In this embodiment, the jetting tool 12 includes a plurality of fluid jet forming nozzles which are disposed in a single plane aligned with the plane of maximum principal stress in the subterranean formation to be fractured. Such alignment may result in the formation of a single fracture extending outwardly from and around the wellbore 130.

As previously described, the fluid inflatable packer 20 includes an open mandrel 22 and a surrounding inflatable element 42 forming an inflation chamber 72 therebetween. Suitable process fluids 70 freely and directly flow into, or enter, the inflation chamber 72 to inflate the fluid inflatable packer 20 and exit the inflation chamber 72 to deflate the fluid inflatable packer 20. In particular, the inflation chamber 72 inflates as process fluid 70 pressure in the open mandrel 22 increases relative to pressure in annulus 148 of wellbore 130 and deflates as process fluid 70 pressure in the open mandrel 22 decreases relative to pressure in the annulus 148. The inflation chamber 72 may inflate and deflate incrementally with changes in process fluid 70 pressure, may inflate to a limit or only begin or continue to inflate after a certain process fluid 70 pressure is reached, and/or may deflate to a limit or only begin or continue to deflate after a certain process fluid 70 pressure is reached. Thus, the inflation chamber 72 may inflate and deflate incrementally with each change in process fluid 70 pressure, in stages with process fluid 70 pressure changes above or below certain values, or only over a portion of the range of process fluid 70 pressure changes. The fluid inflatable packer 20 may be inflated with unfiltered process fluid 70 including frac or other fluid with five, ten, or more pounds of sand or particles per gallon without the inflation chamber 72 becoming filled and/or clogged with sand or particles such that it fails to deflate.

In operation of one embodiment of the invention, the BHA 10 is lowered into and positioned in the wellbore 130 with the tubing string 142. The jetting tool 12 is positioned such that it is exposed to the zone of the wellbore 130 to be treated. In response to pumping of process fluid 70 at high pressures down the tubing string 142 to the jetting tool 12, process fluid 70 enters the fluid inflatable packer 12, passes through the open mandrel 22 into the inflation chamber 72 to inflate the inflatable element 42. As process fluid 70 pressure increases, the fluid inflatable packer 20 continues to expand, at least to a point, to seal the annulus 148 of the wellbore 130 and isolate the treatment zone of the wellbore 130. The fluid inflatable packer 20 is sealed against the wellbore 130, which may be openhole, cased, or otherwise, when the flow of process fluid 70 from one side of the fluid inflatable packer 20 to the other side in the annulus 148 of the wellbore 130 is prevented, substantially prevented, reduced, substantially reduced, limited, or otherwise controlled. The fluid inflatable packer 20 may be configured to seal and release at any suitable process fluid 70 pressure or process fluid 70 pressure range. For example, the fluid inflatable packer 20 may seal at process fluid 70 pressures above 2000 pounds per square inch (psi) and release at lower pressure.

During and after setting of the fluid inflatable packer 20, a jetting process fluid is jetted from the jetting tool 12 to perforate the formation 132. After perforation, as described in more detail below, fracing may be performed by providing a stimulation process fluid through jetting tool 12 to fracture the formation 132. In addition, an additional process fluid may be pumped down the annulus 148 while jetting is continued, discontinued and/or continued at a reduced pressure. For example, if jetting is performed at a pressure of 2000 psi, jetting at a reduced pressure may be performed at 500 psi. Although jetting could also be continued at a higher pressure as well. The additional process fluid may be nitrogen, carbon dioxide, clean gel, sea water, or other suitable process fluid. Upon termination of process fluid 70 pumping, the fluid inflatable packer 20 deflates to the deflated state such that the tubing string 142 and downhole assembly 144 may be retrieved to the surface or repositioned in the wellbore 130.

Figure 5:
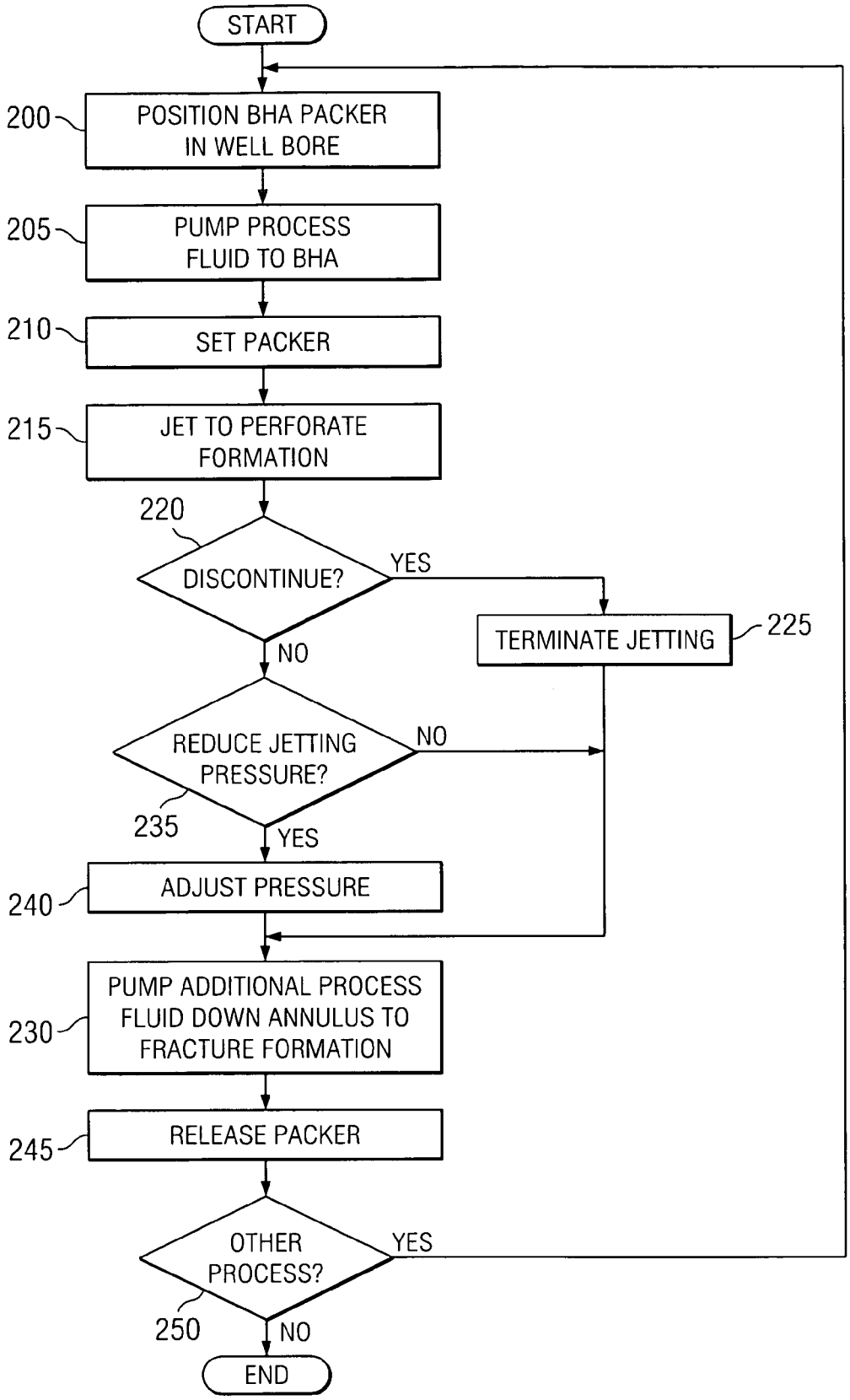
FIG. 5 illustrates one embodiment of a method for deploying and using the BHA of FIG. 1 in a well.

FIG. 5 is one embodiment of a method for deploying and using the BHA 10. The method is described in connection with the frac operation of FIG. 4. The method may be used for any other suitable well treatment or other process.

Referring to FIG. 5, the method begins at step 200 in which the BHA 10 is positioned in the wellbore 130. Next, at step 205, process fluid is pumped to the BHA 10 via the tubing string. At step 210, the packer of the BHA 10 is set in the wellbore 130. As previously described, the packer 14 may be a fluid inflatable packer 20 set based on process fluid pressure.

Proceeding to step 215, jetting process fluid is jetted by the jetting tool 12 to perforate the surrounding formation. Next, at decisional step 220 after perforation, if jetting is to be terminated, the Yes branch leads to step 225. At step 225, the pumping of jetting process fluid down the tubing string is terminated to terminate jetting. At step 230, an additional process fluid is pumped down the annulus of the wellbore 130 to fracture the formation.

Returning to decisional step 220, if jetting is not to be terminated, the No branch leads to decisional step 235. At decisional step 235, if jetting is continued at a reduced pressure, the pumping of jetting process fluid down the tubing string is adjusted to the new pressure at step 240. Step 240 leads to step 230 where, in this case, the additional process fluid is pumped down the annulus to fracture the formation while jetting is continued at the reduced pressure. Returning to decisional step 235, if jetting is continued during fracing at full pressure, the No branch leads to step 230 where additional process fluid is pumped down the annulus for fracing while jetting is continued at full pressure. Thus, jetting may be continued, discontinued or continued in part during fracing. Step 230 leads to step 245 where the packer 12 is released. For the embodiment of the fluid inflatable packer 20, release may be performed by discontinuing pumping of process fluid down the tubing string. At decisional step 250, if another process is to be performed in the wellbore, the Yes branch returns to step 200 where the BHA 10 is repositioned in the wellbore 130. At the completion of all fracing processes in the wellbore 130, the No branch of decisional step 250 leads to the end of the process.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of stimulating a well, comprising the steps of:

setting a fluid inflatable packer of a bottomhole assembly (BHA) in a wellbore using pressure of a process fluid, wherein the BHA comprises the packer and a jetting tool coupled to a tubing string;

jetting a jetting process fluid with the jetting tool to perforate a wall of the wellbore and a formation;

pumping a stimulation process fluid through the jetting tool to fracture the formation; and continuing jetting while pumping an additional process fluid down the annulus of the wellbore to assist fracturing the formation.

2. The method of claim 1 wherein the step of jetting to perforate the wall of the wellbore and the formation is performed at a first pressure, and the method further comprises the step of jetting at a second pressure while pumping the additional process fluid down the annulus of the wellbore.

3. A method of stimulating a well, comprising the steps of:

setting a fluid inflatable packer of a bottomhole assembly (BHA) in a wellbore using pressure of a process fluid, wherein the BHA comprises the packer and a jetting tool coupled to a tubing string;

jetting at a first pressure a jetting process fluid with the jetting tool to perforate a wall of the wellbore and a formation;

pumping a stimulation process fluid through the jetting tool to fracture the formation; and jetting at a second pressure while pumping an additional process fluid down the annulus of the wellbore.

4. A method of claim 3 wherein the tubing comprises coil tubing.

5. A method for stimulating a well, comprising the steps of:

inflating a fluid inflatable packer with a process fluid pumped down a tubing string to a jetting tool, wherein the jetting tool is coupled to the fluid inflatable packer;

perforating a wall of a wellbore and a formation by jetting a jetting process fluid through jets of the jetting tool; and fracing the formation by pumping a stimulation process fluid down an annulus between the tubing and a wellbore of the well.

6. The method of claim 5 further comprising the step of continuing jetting by pumping an additional process fluid down the tubing through the jets to hydraulically fracture the formation.

7. The method of claim 5 further comprising the step of discontinuing jetting while pumping the stimulation process fluid down the annulus of the wellbore.

8. The method of claim 5 further comprising the step of discontinuing jetting while pumping the stimulation process fluid down the annulus of the wellbore.

9. The method of claim 5 wherein the step of jetting to perforate the formation is performed at a first pressure, and the method further comprises the step of jetting at a second reduced pressure while pumping the stimulation process fluid down the annulus of the wellbore.

10. The method of claim 5 further comprising the step of deflating the fluid inflatable packer by dropping fluid pressure in the tubing string.

* * * * *